US006407489B1

(12) United States Patent
Lee

(10) Patent No.: US 6,407,489 B1
(45) Date of Patent: Jun. 18, 2002

(54) SHADOW MASK FOR CATHODE RAY TUBE

(75) Inventor: Jong-Bin Lee, Kyungki-do (KR)

(73) Assignee: Samsung Display Devices Co., Ltd., Suwon-si (KR)

( * ) Notice: Subject to any disclaimer, the term of this patent is extended or adjusted under 35 U.S.C. 154(b) by 0 days.

(21) Appl. No.: 09/433,639

(22) Filed: Nov. 3, 1999

(30) Foreign Application Priority Data

Nov. 6, 1998 (KR) ..... 98-47459

(51) Int. Cl.[7] ..... H01J 29/50
(52) U.S. Cl. ..... 313/402; 313/403
(58) Field of Search ..... 313/403, 402, 313/404, 407

(56) References Cited

U.S. PATENT DOCUMENTS 6,057,640 A * 5/2000 Aibara ..... 313/403 X

* cited by examiner

*Primary Examiner*—Ashok Patel
(74) *Attorney, Agent, or Firm*—Christie, Parker & Hale, LLP

(57) ABSTRACT

A shadow mask for a cathode ray tube includes a beam-guide member having a substantially rectangular shape with short opposite sides in a vertical axis direction and long opposite sides in a horizontal axis direction. The beam-guide member is provided with a plurality of apertures and tie bars interconnecting the neighboring apertures in the vertical and horizontal axis directions. Each aperture has an opening portion and a tapering portion surrounding the opening portion. A skirt with a bent end portion is extended from the beam-guide member. The beam-guide member is structured such that the relationship of a length A of the tie bar in the vertical axis direction to a pitch Pv between the neighboring apertures in the vertical axis direction satisfies the following condition: $0.05 \leqq APv \leqq 0.15$.

19 Claims, 5 Drawing Sheets

SHADOW MASK FOR CATHODE RAY TUBE

FIELD OF THE INVENTION

The present invention relates to a shadow mask for a cathode ray tube (CRT) and, more particularly, to a shadow mask that is adapted for use in a large-sized flat panel CRT.

BACKGROUND OF THE INVENTION

Generally, in a CRT application, a shadow mask is mounted within a faceplate panel with an inner phosphor screen so that the shadow mask faces the inner phosphor screen at a close distance. The shadow mask has a plurality of beam-guide apertures that ensure that each of R, G and B electron beams strikes only its intended phosphor on the phosphor screen.

The shadow mask has an overall shape corresponding to that of the internal surface of the faceplate panel with the phosphor screen. Recently, as large-sized flat panel CRTs have been the choice of consumers, shadow masks have become flat in accordance with the flat shape of the CRT panel. However, the flat-shaped shadow mask exhibits poor performance characteristics in a CRT application.

For instance, the shadow mask having a radius of curvature of 1.6R or more exhibits weakness in intensity so that it is liable to suffer deformation at external shocks. Such a deformation of the shadow mask causes serious device failure.

Furthermore, a flat-shaped shadow mask involves a serious doming phenomenon. It is well known that 70% or more of the electron beams emitted from the electron gun do not pass through beam-guide apertures of the shadow mask, and strike the non-aperture portions of the shadow mask. The electron beams striking the shadow mask induce thermal transformation of the shadow mask so that the beam-guide apertures of the shadow mask deviate from their proper positions and the electron beams leaving the shadow mask cannot correctly land in the proper position on the phosphor screen. The doming phenomenon becomes particularly serious when the shadow mask becomes flat, resulting in poor color purity.

The flat-shaped shadow mask further involves a serious howling phenomenon. The flat-shaped shadow mask is liable to vibrate due to external factors such as a sound pressure from the speaker. This howling phenomenon also becomes particularly serious when the shadow mask becomes flat, resulting in poor display image.

SUMMARY OF THE INVENTION

It is an object of the present invention to provide a shadow mask that can be well adapted to use in a large-sized flat panel CRT.

This and other objects may be achieved by a shadow mask including a beam-guide member having a substantially rectangular shape with opposite sides in a first axis direction and opposite sides in a second axis direction, the sides in the first axis direction being shorter than those in the second axis direction. The beam-guide member is provided with a plurality of apertures and tie bars interconnecting the neighboring apertures in the first and second axis directions. Each aperture has an opening portion and a tapering portion surrounding the opening portion. A skirt with a bent end portion is extended from the beam-guide member.

The beam-guide member is structured such that the relation of a length A of the tie bar in the first axis direction to a pitch Pv between the neighboring apertures in the first axis direction satisfies the following condition: $0.05 \leqq A/Pv \leqq 0.15$. The pitch Pv is established to be in the range of 0.6 mm to about 1.0 mm, and the length A of the tie bar is established to be in the range of 0.05 mm to about 0.09 mm. The relation of the length A of the tie bar to a distance B between adjacent end lines of the opening portions of the neighboring apertures in the first axis direction satisfies the following condition: $0.185 \leqq A/B \leqq 0.818$. The distance B between the adjacent end lines of the opening portions of the neighboring apertures in the first axis direction is established to be in the range of 0.11 mm to about 0.27 mm. A radius of curvature RS of the shadow mask satisfies the following condition: $1.6R \leqq RS \leqq 4R$ where 1R indicates a diagonal length of an effective screen area of the panel multiplied by 1.767.

Alternatively, the shadow mask may have varying curvature radii R1 and R2 in different areas. In this case, the curvature radius R1 at the two third horizontal area of the beam-guide member on the basis of a central axis of the beam-guide member, and the curvature radius R2 at the remaining one third horizontal area of the beam-guide member satisfy the following condition: $R2 \times 1.5 \leqq R1 \leqq R2 \times 5$.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Preferred embodiments of this invention will be explained with reference to the accompanying drawings.

Figure 1:
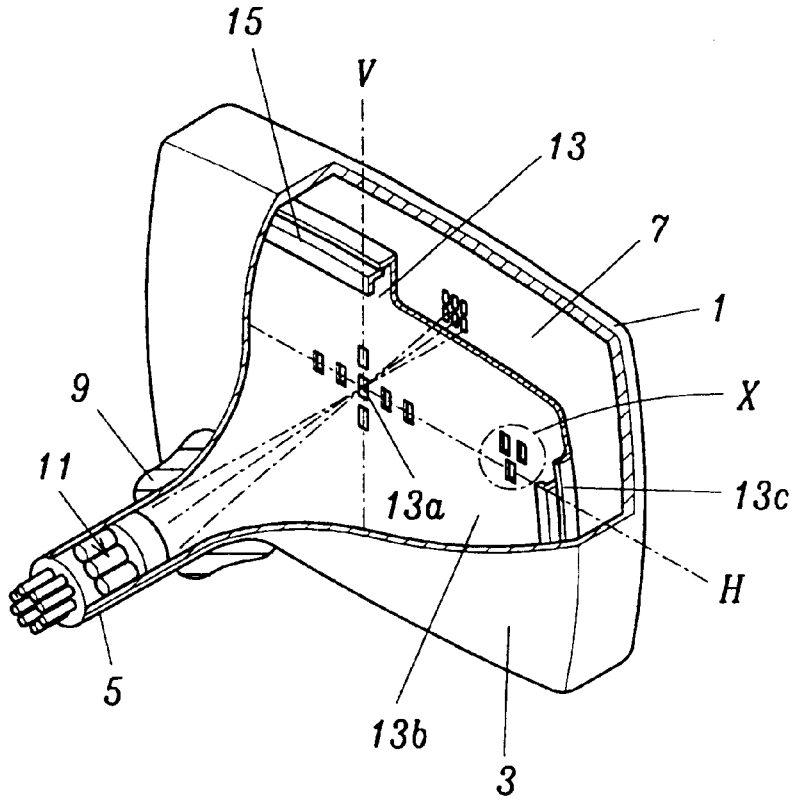
FIG. 1 is a partial sectional perspective view of a CRT with a faceplate panel and a shadow mask according to a first preferred embodiment of the present invention.
Figure 2:
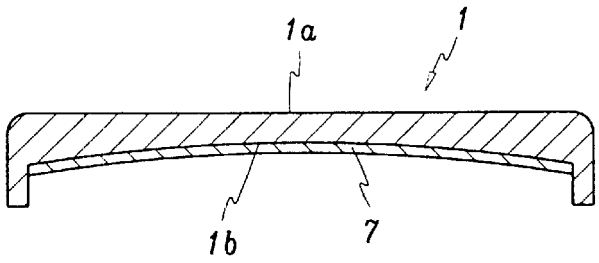
FIG. 2 is a cross sectional view of the faceplate panel shown in FIG. 1.

FIG. 1 is a partial sectional perspective view of a CRT with a faceplate panel 1 according to a first preferred embodiment of the present invention, and FIG. 2 is a cross sectional view of the faceplate panel 1 shown in FIG. 1. The faceplate panel 1 has a flat outer surface 1*a* and an inner curved surface 1*b*. A phosphor screen 7 is formed on the inner curved surface 1*b* of the panel 1. A funnel 3 and a neck 5 are sequentially connected to the panel 1 at the rear of the phosphor screen 7.

An electron gun 11 is fitted within the neck 5 to produce R, G and B electron beams, and a deflection yoke 9 is mounted around the funnel 3 to deflect the electron beams if required.

A color selection shadow mask 13 is mounted within the panel 1 by using a mask frame 15 as a support. The shadow mask 13 has a beam-guide member 13*b* corresponding to the effective screen area of the panel 1, and a skirt 13*c* extended from the beam-guide member 13*b* with a bent end portion. The beam-guide member 13*b* is substantially rectangular-shaped with long opposite sides in a horizontal axis direction H and short opposite sides in a vertical axis direction V. The beam-guide member 13*b* has a plurality of apertures 13*a* for selectively passing the R, G and B electron beams, and tie bars interconnecting the neighboring apertures 13*a* in the horizontal and vertical axis directions H and V.

Figure 3:
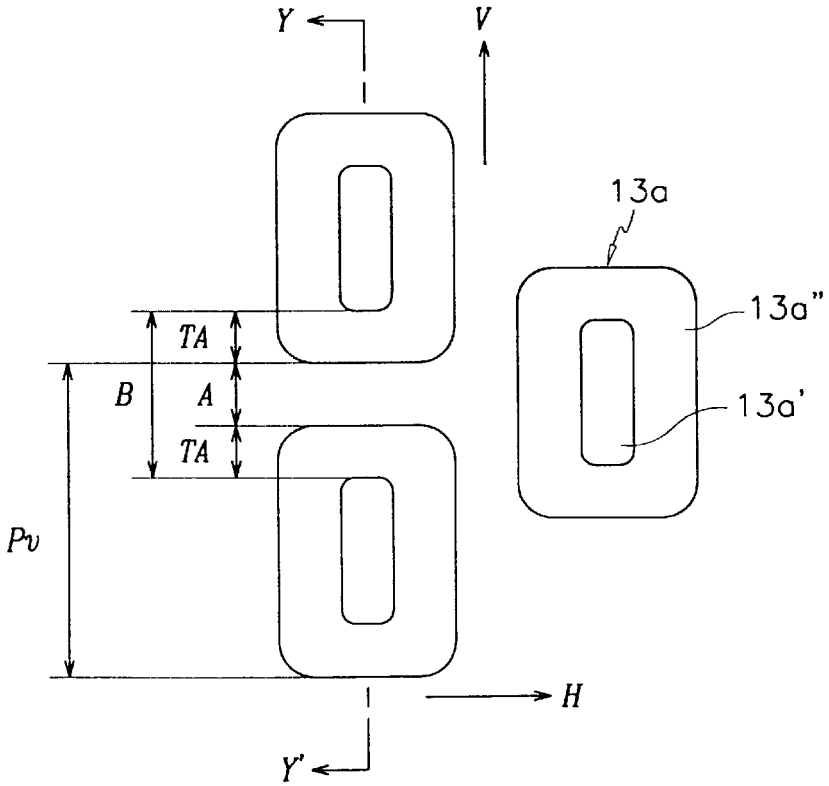
FIG. 3 is an amplified view of the X portion of the shadow mask shown in FIG. 1.
Figure 4:
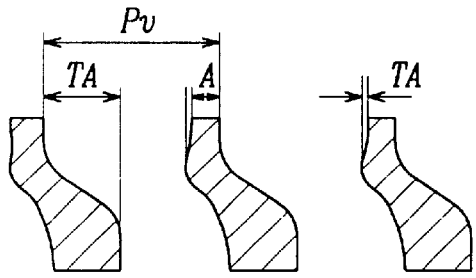
FIG. 4 is a cross sectional view of the shadow mask taken along the Y–Y' line of FIG. 3.

FIG. 3 is an amplified view of the X portion of the shadow mask 13 shown in FIG. 1, and FIG. 4 is a cross sectional view of the shadow mask 13 taken along the Y–Y' line of FIG. 3. Each of the apertures 13*a* has an opening portion 13*a*' and a tapering portion 13*a*" surrounding the opening portion 13*a*. In the drawings, Pv indicates the pitch between the neighboring apertures 13*a* in the vertical axis direction V (i.e., the distance between center lines or alternate end lines of the neighboring apertures 13*a* in the vertical axis direction v), A indicates the length of the tie bar interconnecting the neighboring apertures 13*a* in the vertical axis direction V (i.e., the distance between adjacent end lines of the neighboring apertures 13*a* in the vertical axis direction v), B indicates the distance between the adjacent end lines of the opening portions 13*a* ' of the neighboring apertures 13*a* in the vertical axis direction V, and TA indicates the width of the tapering portion 13*a*" of the aperture 13*a* in the vertical axis direction V.

The apertures 13*a* are formed at the beam-guide member 13*b* such that the relationship of A to Pv satisfies the following condition: $0.05 \leqq A/Pv \leqq 0.15$.

It is preferable that A is established to be in the range of 0.05 mm to about 0.09 mm, and Pv is established to be in the range of 0.6 mm to about 1.0 mm. The length A of the tie bar is gradually enlarged from the center portion of the beam-guide member 13*b* to the peripheral portion. This is to increase a transmission ratio of the electron beams at the center portion of the beam-guide member 13*b* where maximum brightness is required.

Furthermore, the apertures 13*a* are formed at the beam-guide member 13*b* such that the relationship of A to B satisfies the following condition: $0.185 \leqq A/B \leqq 0.818$. Preferably B is established to be in the range of 0.11 mm to about 0.27 mm.

In the meantime, the inner curved surface 1*b* of the panel 1 has a radius of curvature Rp in the range of $2.1R \leqq Rp \leqq 8R$ where 1R indicates the diagonal length of the effective screen area of the panel 1 multiplied by 1.767. Correspondingly, the shadow mask 13 has a curvature radius Rs in the range of $1.6R \leqq Rs \leqq 4R$.

Figure 5:
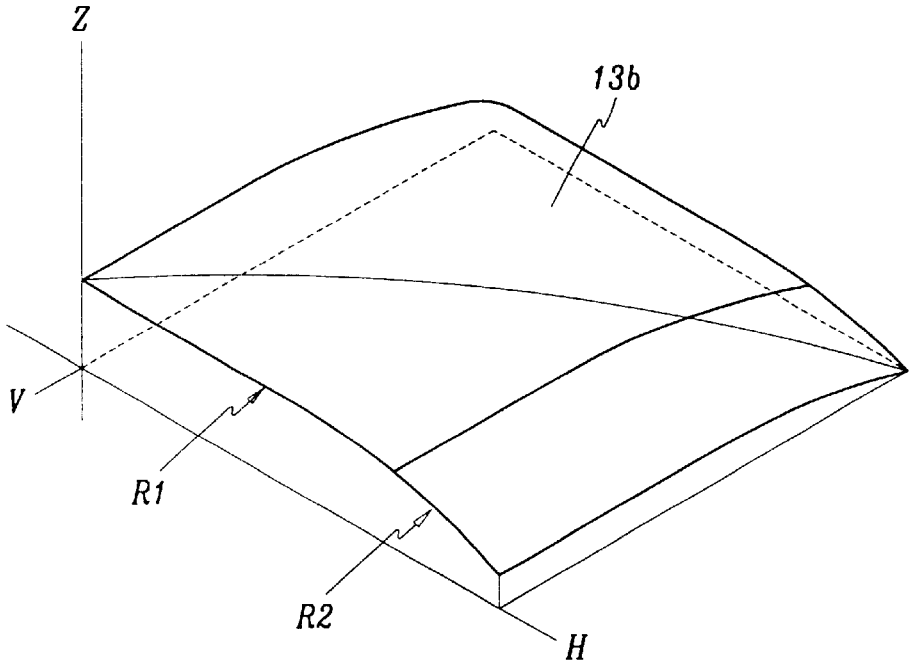
FIG. 5 is a schematic perspective view of a quarter portion of a shadow mask according to a second preferred embodiment of the present invention.

FIG. 5 is a schematic perspective view of a quarter portion of a shadow mask according to a second preferred embodiment of the present invention. In the drawing, Z indicates a central axis line drawing through the center of the beam-guide member 13*b* normal thereto, R1 indicates the curvature radius at the two third horizontal area of the beam-guide member 13*b* on the basis of the central axis line Z, and R2 indicates the curvature radius at the remaining one third horizontal area of the beam-guide member 13*b*.

In this preferred embodiment, other components of the shadow mask 13 are the same as those related to the first preferred embodiment except that the shadow mask 13 has varying curvature radii R1 and R2 in different areas. The beam-guide member 13*b* is formed such that R1 and R2 satisfy the following condition: $R2 \times 1.5 \leqq R1 \leqq R2 \times 5$.

In the above structure, the center portion of the beam-guide member 13*b* has a curvature radius larger than that of the peripheral portion. This structure helps to enhance the performance characteristics of the shadow mask 13.

Figure 8:
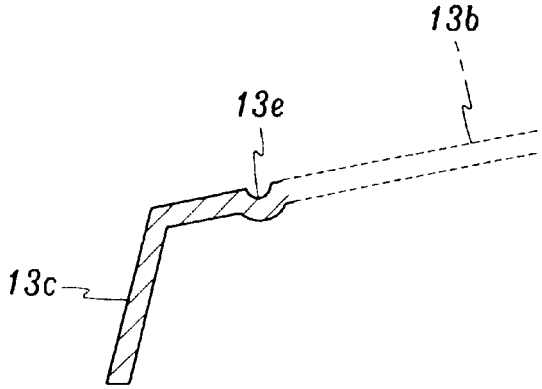
FIG. 8 is a partial sectional view of the shadow mask shown in FIG. 1.

Meanwhile, as shown in FIG. 8, a hemisphere-shaped bead 13*e* may be formed between the beam-guide member 13*b* and the skirt 13*c* to reinforce intensity of the shadow mask 13 . Alternatively, anti-doming printing may be performed with respect to the beam-striking surface of the shadow mask 13.

The thickness T of the shadow mask 13 is established to be in the range of 0.18 mm to about 0.25 mm. It is preferable that the relationship of the length A of the bar to the thickness T of the shadow mask 13 satisfies the following condition: $0.5 < A/T < 0.2$.

The following examples further illustrate the present invention.

EXAMPLE 1

A shadow mask satisfying the following specific conditions was produced and the performance characteristics of the shadow mask was tested in a CRT application.

Specific conditions of the shadow mask:

(1) Thickness: 0.25 mm, (2) Radius of curvature Rs: 1.9R, (3) Length of tie bar A: 0.07 mm, Vertical pitch Vp: 0.69 mm, (5) Size of CRT: 29 inch, and (6) Effective screen size of CRT in horizontal, vertical and diagonal directions: 540.8×405.6×676 mm.

Comparative Example 1

A shadow mask satisfying the following specific conditions was produced and the performance characteristics of the shadow mask was tested in a CRT application.

Specific conditions of the shadow mask:

(1) Thickness: 0.25 mm, (2) Radius of curvature Rs: 1.5R, (3) Length of tie bar A: 0.03 mm, Vertical pitch Vp: 0.74 mm, (5) Size of CRT: 29 inch, and (6) Effective screen size of CRT in horizontal, vertical and diagonal directions: 540.8×405.6×676 mm.

Intensity Characteristic

Figure 6:
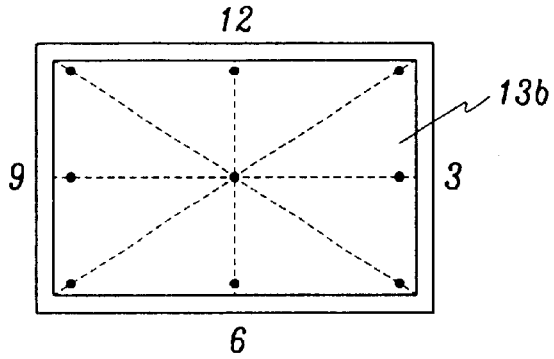
FIG. 6 is a schematic plan view of the shadow mask shown in FIG. 5.

The intensity characteristics of the shadow masks according to Example 1 and Comparative Example 1 were tested by the so-called dropping intensity measurement. The dropping intensity measurement measures the maximum landing variation occurring when the CRT with the shadow mask drops at a predetermined height in various directions. As shown in FIG. 6, the measurement was performed at nine points on a center portion, four corner portions and four side-middle portions of the beam-guide member 13*b*. The results are listed in Table 1.

TABLE 1

| | Maximum landing variation | |
|---|---|---|
| Height of dropping | Comparative Example 1 | Example 1 |
| 15 cm | 12 μm | 5 μm |
| 20 cm | 25 μm | 8 μm |
| 25 cm | 42 μm | 11 μm |

TABLE 1-continued

| Height of dropping | Maximum landing variation | |
|---|---|---|
| | Comparative Example 1 | Example 1 |
| 30 cm | 60 μm | 16 μm |
| 35 cm | 82 μm | 27 μm |

As shown in Table 1, the shadow mask according to Example 1 exhibited largely reduced maximum landing variation compared to the shadow mask according to Comparative Example 1. This means that the shadow mask according to Example 1 has a good intensity characteristic.

Doming Characteristic

Figure 7:
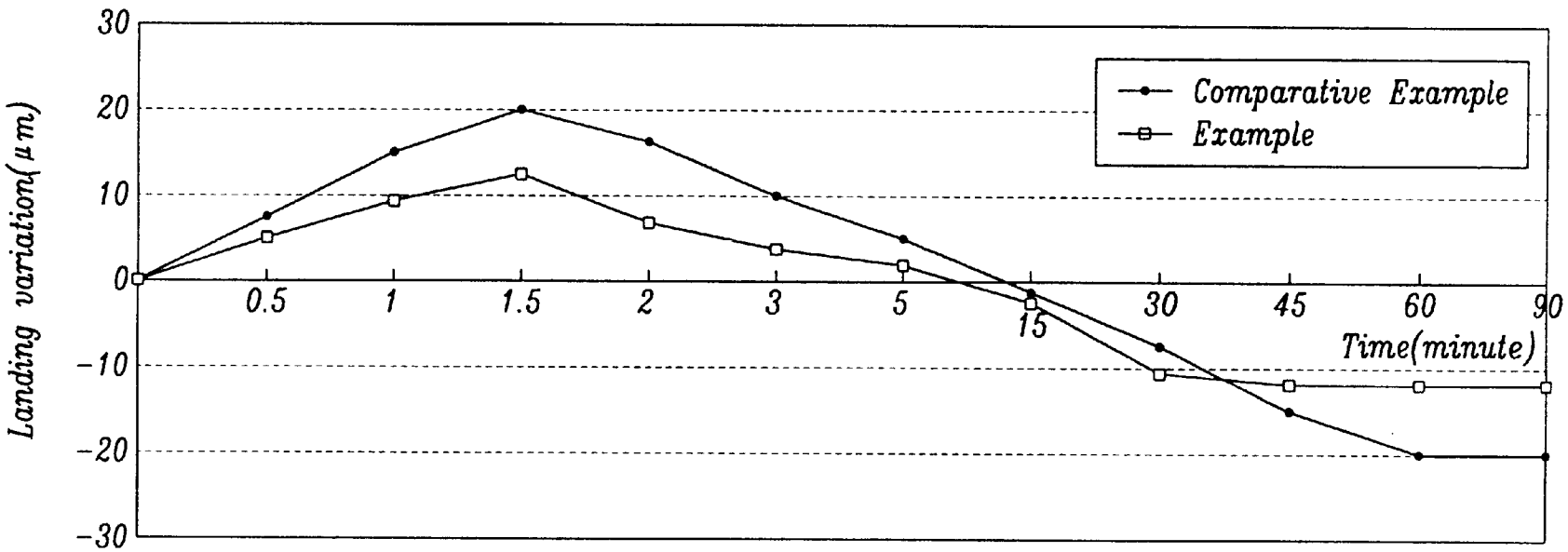
FIG. 7 is a graph illustrating the landing variation of the shadow mask shown in FIG. 1 as a function of time.

The doming characteristics of the shadow masks according to Example 1 and Comparative Example 1 were measured at two points on the vertical side-middle portions shown in FIG. 6. The results are illustrated in FIG. 7. As shown in the drawing, the shadow mask according to Example 1 exhibited largely reduced landing variation as a function of time compared to the shadow mask according to Comparative Example 1. This means that the shadow mask according to Example 1 has a good doming characteristic.

Howling Characteristic

The results measured with respect to the howling characteristics of the shadow masks according to Example 1 and Comparative Example 1 are listed in Table 2 where Frequency band indicates the range of frequencies at which howling is perceived with a maximum speaker volume of 100 volume units (VU), and Speaker volume indicates the value of volume with which howling is perceived at the relevant frequency.

TABLE 2

| | Comparative Example 1 | | Example 1 | |
|---|---|---|---|---|
| | Frequency band | Speaker volume | Frequency band | Speaker volume |
| 0~100 Hz | 24 to 75 Hz | 24 Hz-67, 32 Hz-24, 39 Hz-40, 36 Hz-55, 75 Hz-37 | 93 Hz | 93 Hz-32 |
| 101~200 Hz | 120 to 185 Hz | 120 Hz-16, 145 Hz-30, 185 Hz-17 | 115 to 190 Hz | 115 Hz-52, 170 Hz-21, 190 Hz-23 |
| 201~300 Hz | 250 to 290 Hz | 250 Hz-15, 290 Hz-20 | 230 to 285 Hz | 230 Hz-25, 285 Hz-30 |
| 301 Hz or more | 310 Hz | 31 Hz-16 | 320 Hz | 320 Hz-57 |

The volume range in which a user commonly enjoys sounds from audio electronics is approximately 10 to 25 volume units (VU). As indicated in Table 2, the shadow mask according to Comparative Example 1 exhibited the howling phenomenon at various frequencies in a volume range of use. In contrast, the shadow mask according to Example 1 exhibited the howling phenomenon at various frequencies in a volume range of non-use. This means that the shadow mask according to Example 1 has a good howling characteristic.

All of the above-described experimental results show that the inventive shadow mask has good performance characteristics. The shadow mask having such good performance characteristics can be well adapted for use in large-sized flat panel CRTs.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A shadow mask for a cathode ray tube comprising:

a beam-guide member having a substantially rectangular shape with short opposite sides in a vertical axis direction and long opposite sides in a horizontal axis direction, the beam-guide member comprising a plurality of apertures and tie bars interconnecting neighboring apertures in the vertical and horizontal axis directions, each aperture having an opening portion and a tapering portion surrounding the opening portion; and a skirt extended from the beam-guide member with a bent end portion;

wherein the beam-guide member is structured such that the relation of a length A of a tie bar in the vertical axis direction to a pitch Pv between the neighboring apertures in the vertical axis direction satisfies the following condition: $0.05 \leqq A/Pv \leqq 0.15$, and wherein the vertical pitch Pv is established to be in the range of 0.6 mm to about 1.0 mm.

2. The shadow mask of claim 1 wherein the length A of the tie bar is established to be in the range of 0.05 mm to about 0.09 mm.

3. The shadow mask of claim 1 wherein the relation of the length A of the tie bar to a distance B between adjacent end lines of the opening portions of the neighboring apertures in the vertical axis direction satisfies the following condition: $0.185 \leqq A/B \leqq 0.818$.

4. The shadow mask of claim 3 wherein the distance B between the adjacent end lines of the opening portions of the neighboring apertures in the vertical axis direction is established to be in the range of 0.11 mm to about 0.27 mm.

5. A shadow mask for a cathode ray tube comprising:

a beam-guide member having a substantially rectangular shape with short opposite sides in a vertical axis direction and long opposite sides in a horizontal axis direction, the beam-guide member comprising a plurality of apertures and tie bars interconnecting neighboring apertures in the vertical and horizontal axis directions, each aperture having an opening portion and a tapering portion surrounding the opening portion; and a skirt extended from the beam-guide member with a bent end portion;

wherein the beam-guide member is structured such that the relation of a length A of the tie bar in the vertical axis direction to a pitch Pv between the neighboring apertures in the vertical axis direction satisfies the following condition: $0.05 \leqq A/Pv \leqq 0.15$, and wherein a radius of curvature Rs of the shadow mask satisfies the following condition: $1.6R \leqq Rs \leqq 4R$ where 1R indicates a diagonal length of an effective screen area of the panel multiplied by 1.767.

6. The shadow mask of claim 5 wherein a radius of curvature R1 at the two third horizontal area of the beam-guide member on the basis of a central axis of the beam-guide member, and another curvature radius R2 at the remaining one third horizontal area of the beam-guide member satisfy the following condition: $R2 \times 1.5 \leqq R1 \leqq R2 \times 5$.

7. The shadow mask of claim 5 wherein the vertical pitch Pv is established to be in the range of 0.6 mm to about 1.0 mm.

8. The shadow mask of claim 5 wherein the length A of the tie bar is established to be in the range of 0.05 mm to about 0.09 mm.

9. The shadow mask of claim 5 wherein the relation of the length A of the tie bar to a distance B between adjacent end lines of the opening portions of the neighboring aperture in the vertical axis direction satisfies the following condition: $0.185 \leqq A/B \leqq 0.818$.

10. The shadow mask of claim 9 wherein the distance B between the adjacent end lines of opening portions of the neighboring apertures in the vertical axis direction is established to be in the range of 0.11 mm to about 0.27 mm.

11. A cathode ray tube comprising:

a faceplate panel having a flat outer surface, and an inner curved surface with a phosphor screen; and a shadow mask mounted within the panel such that the shadow mask faces the phosphor screen at a close distance, the shadow mask comprising a beam-guide member having a substantially rectangular shape with short opposite sides in a vertical axis direction and long opposite sides in a horizontal axis direction, the beam-guide member comprising a plurality of apertures and tie bars interconnecting neighboring apertures in the vertical and horizontal axis directions, each aperture having an opening portion and a tapering portion surrounding the opening portion;

wherein the beam-guide member is structured such that the relation of a length A of the tie bar in the vertical axis direction to a pitch Pv between the neighboring apertures in the vertical axis direction satisfies the following condition: $0.05 \leqq A/Pv \leqq 0.15$, and wherein a radius of curvature Rp of the inner curved surface of the faceplate panel satisfies the following condition: $2.1R \leqq Rp \leqq 8R$ where 1R indicates a diagonal length of an effective screen area of the panel multiplied by 1.767.

12. The cathode ray tube of claim 11 wherein a radius of curvature Rs of the shadow mask satisfies the following condition: $1.6R \leqq Rs \leqq 4R$ where 1R indicates a diagonal length of an effective screen area of the panel multiplied by 1.767.

13. The cathode ray tube of claim 11 wherein a radius of curvature R1 at the two third horizontal area of the beam-guide member on the basis of a central axis of the beam-guide member, and another curvature radius R2 at the remaining one third horizontal area of the beam-guide member satisfy the following condition: $R2 \times 1.5 \leqq R1 \leqq R2 \times 5$.

14. A shadow mask for a cathode ray tube comprising:

a beam-guide member having a substantially rectangular shape, the beam-guide member comprising a plurality of apertures spaced apart by a pitch in a first axis direction, each of the apertures having an opened portion and a tapered portion surrounding the opened portion, and a plurality of tie bars each having a length in the first axis direction, wherein the length to the pitch ratio is in the range of 0.05 and 0.15; and a skirt extended from the beam-guide member, the skirt having a bent end portion, wherein a radius of curvature R1 of a first portion of the beam-guide member, and a radius of curvature R2 at a remaining portion of the beam-guide member satisfy the following condition: $R2 \times 1.5 \leqq R1 \leqq R2 \times 5$, wherein an arc length of the first portion is approximately twice an arc length of the remaining portion.

15. The shadow mask of claim 14 wherein the length of one of the tie bars is in the range of 0.05 mm to about 0.09 mm.

16. The shadow mask of claim 14 wherein the ratio of the length of one of the tie bars to a distance between adjacent ends of the opened portions of two neighboring apertures in the first axis direction is in the range of 0.185 to 0.818.

17. The shadow mask of claim 16 wherein the distance between the adjacent ends of the opened portions is in the range of 0.11 mm to about 0.27 mm.

18. The shadow mask of claim 14 wherein a radius of curvature Rs of the shadow mask satisfies the following condition: $1.6R \leqq Rs \leqq 4R$ where R is a diagonal length of an effective screen area of the panel multiplied by 1.767.

19. The shadow mask of claim 14 wherein the pitch between the apertures is in the range of 0.6 mm to about 1.0 mm.

* * * * *